US009166340B2

(12) United States Patent
Bergmann et al.

(10) Patent No.: US 9,166,340 B2
(45) Date of Patent: Oct. 20, 2015

(54) CONNECTOR

(71) Applicant: Siemens Aktiengesellschaft, Munich (DE)

(72) Inventors: Martin Bergmann, Schnaittenbach (DE); Andreas Mulzer, Schmidgaden/Trisching (DE)

(73) Assignee: Siemens Aktiengesellschaft, Munich (DE)

( * ) Notice: Subject to any disclaimer, the term of this patent is extended or adjusted under 35 U.S.C. 154(b) by 9 days.

(21) Appl. No.: 14/252,280

(22) Filed: Apr. 14, 2014

(65) Prior Publication Data

US 2014/0308831 A1 Oct. 16, 2014

(30) Foreign Application Priority Data

Apr. 15, 2013 (EP) ..... 13163683

(51) Int. Cl.
*H01R 13/645* (2006.01)
*H01R 13/46* (2006.01)

(52) U.S. Cl.
CPC ..... *H01R 13/645* (2013.01); *H01R 13/465* (2013.01)

(58) Field of Classification Search
CPC ..... H01R 13/6456
USPC ..... 439/156, 677, 681, 680, 133
See application file for complete search history.

(56) References Cited

U.S. PATENT DOCUMENTS

| | | | | | |
|---|---|---|---|---|---|
| 3,950,059 | A * | 4/1976 | Anhalt et al. | ..... | 439/261 |
| 4,232,930 | A * | 11/1980 | Teti | ..... | 439/680 |
| 4,790,763 | A * | 12/1988 | Weber et al. | ..... | 439/65 |
| 5,449,302 | A | 9/1995 | Yarbrough et al. | | |
| 6,089,898 | A | 7/2000 | Lincoln, III et al. | | |
| 6,974,342 | B2 * | 12/2005 | Thomas | ..... | 439/222 |
| 2001/0039147 | A1 * | 11/2001 | Sugiura et al. | ..... | 439/680 |

FOREIGN PATENT DOCUMENTS

| | | | | |
|---|---|---|---|---|
| DE | 25 34 775 | A1 | 2/1977 | |
| DE | 199 09 807 | A1 | 9/1999 | |
| DE | 195 14 842 | B4 | 11/2004 | |
| FR | 2835391 | A1 * | 8/2003 | ..... H05K 7/14 |
| WO | WO 00/62380 | A1 | 10/2000 | |

* cited by examiner

*Primary Examiner* — Abdullah Riyami
*Assistant Examiner* — Nelson R Burgos-Guntin
(74) *Attorney, Agent, or Firm* — Cozen O'Connor

(57) ABSTRACT

A connector for disconnecting electrical lines from a module or connecting them to the module includes a first housing part formed as a flap and a second housing part second housing part formed as a base part with an inner and outer sides, and a coding element receptacle for accepting a coding element, which interacts with a mating coding element disposed in the module, wherein the coding element receptacle is integrated into the base part and, looking towards the inner side, bears a first label field, and the base part is formed on the outer side in the area of the coding element receptacle with an opening and a second label field assigned to the opening, and in addition to numbers/letters, the label fields have marking lines disposed such that, when the coding element is plugged in, the markings match markings disposed on the coding element.

7 Claims, 6 Drawing Sheets

CONNECTOR

BACKGROUND OF THE INVENTION

1. Field of the Invention

The invention relates to a connector for disconnecting electrical lines from a module and connecting them to the module, comprising a first housing part and a second housing part, where the first housing part has a hinged connection to the second housing part to fold the two housing parts together into a housing, and a coding element receptacle for accepting a coding element, which interacts with a mating coding element disposed in the module, and where the coding element and the mating coding element are configured in accordance with the lock-and-key principle.

2. Description of the Related Art

In order to guarantee a unique assignment of a connector to a module, a module with a process connector with a coding element and a mating coding element are already known from DE 195 14 842 B4.

SUMMARY OF THE INVENTION

It is an object of the invention to provide a connector in which an option is created for rapidly recognizing a wiring configuration of the connector in order, for example, to make installation easier for a person installing electrical lines on electrical connectors.

This and other objects and advantages are achieved in accordance with the invention by providing a connector in which a first housing part is formed as a flap and the second housing part is formed as a base part with an inner side and an outer side, where the coding element receptacle is integrated into the base part and bears a first label field viewed in a direction towards the inner side. In addition, the base part is formed on the outer side in the area of the coding element receptacle with an opening and a second label field assigned to the opening. In this case, the label fields have marking lines in addition to numbers and letters, with the marking lines being disposed so that they match markings disposed on the coding element when the coding element is plugged in.

Installation work is made easier by the invention for an installer with the task of supplying a specific module with a supply voltage via a connector, for example. Preferably, the installer takes a module out of a packaging unit with already pre-plugged connectors. That installer will install this module in accordance with the power supply system provided. If during the installation process he disconnects the pre-plugged connector from the module, he releases the coding element from the mating coding element of the module. For example, if the module is oriented for a voltage system of 24 V DC, accordingly in the module the mating coding element for the coding element is oriented for 24 V DC. The markings on the coding element accordingly indicate in the first and second label field the voltage systems assigned to the marking lines. Even before the installer has opened the connector for connection of electrical lines, he can recognize the assigned voltage system from the opening in conjunction with the second label field. If the installer now begins to work on connecting the electrical lines to the connector, he will open the flap of the connector and glance at the inner side of the base part and thus at the first label field, which for its part shows the different voltage systems, because the markings of the coding element for their part are aligned so that they also show the associated voltage system on the first label field on the inner side of the connector, a danger of confusion between lines to be connected is reduced for the installer.

The label fields have circuit information in relation to the electrical lines.

Advantageously the information content of the wiring configuration information of the first label field is essentially identical to the information content relating to the wiring configuration information of the second label field.

It is also advantageous for the coding element to be formed such that it latches into the coding element receptacle as a captive element.

It is especially advantageous for the coding element to be embodied in a square shape and for the markings to be disposed on the side surfaces such that the markings on opposing side surfaces correspond to one another and thus the same information is shown in each label field.

Preferably, the connector is formed so as to be able to be used as a power supply connection for automation modules with operating voltages for voltage systems from the groups: 24 V DC, 24 V/28 V/60 V DC, 120 V, 230 V AC.

Regarding assembling a connector and a module in a manufacturing plant, the connector is advantageously formed such that the coding element is transferred from the module to the connector the first time that the connector is connected to the module and latches into the connector.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The drawings show an exemplary embodiment of the connector, in which.

DETAILED DESCRIPTION OF THE PREFERRED EMBODIMENTS

Figure 1:
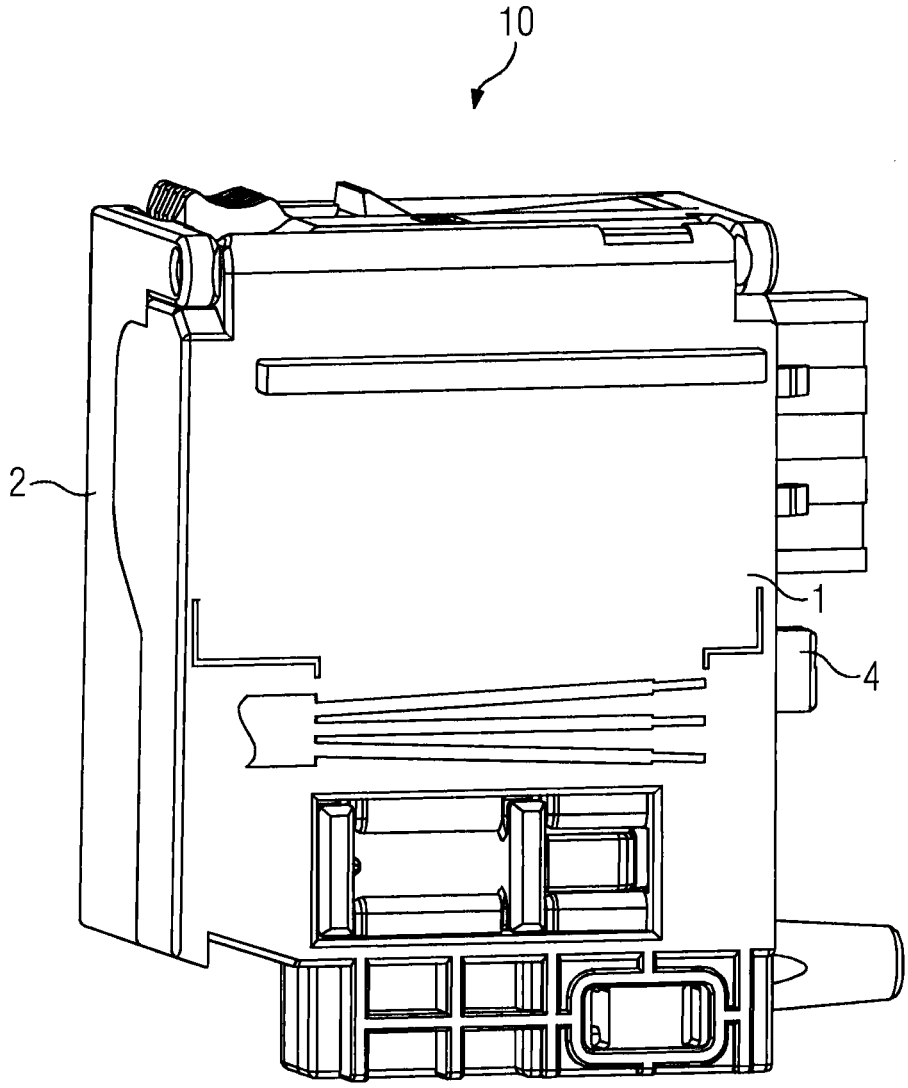
FIG. 1 shows a connector in a first perspective view in accordance with the invention.

In accordance with FIG. 1, a connector 10 is depicted for disconnecting electrical modules from a module and connecting them to the module. The connector 10 comprises a first housing part 1 and a second housing part 2, where the first housing part 1 has a hinged connection to the second housing part 2. The first housing part 1 is formed as a flap and the second housing part 2 is formed as a base part. As a result, the first housing part 1 can be hinged away for configuring the wiring of the connector 10.

So that the connector 10 can only be plugged into modules intended for the connector, it has a coding element 4. The coding element 4 of the connector 10 interacts with a mating coding element disposed in the module such that the lock-and-key principle is realized. This means that only one connector that is intended for the module can ever be plugged into the module.

Figure 2:
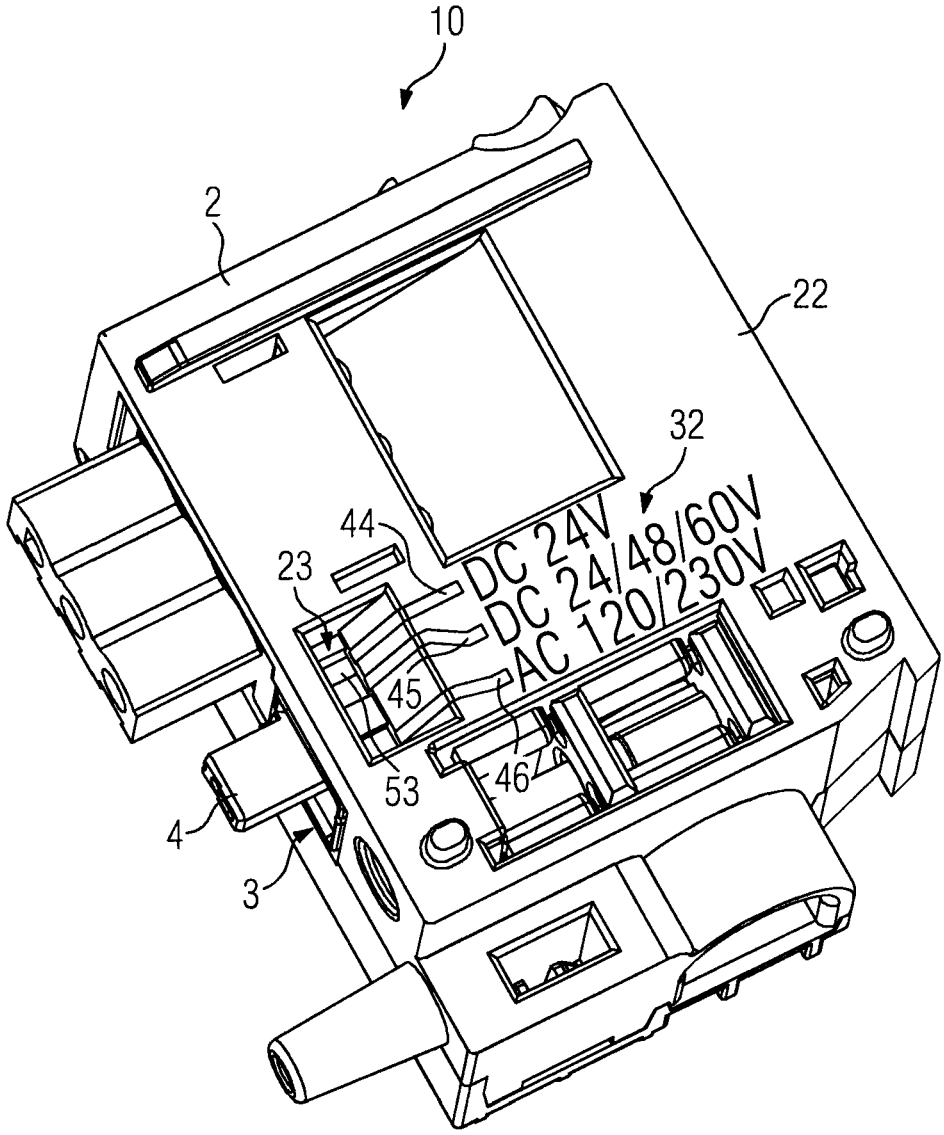
FIG. 2 shows the connector in a second perspective view in accordance with the invention.

FIG. 2 shows the connector 10 in a perspective view looking towards a rear side of the second housing part 2. The rear side of the second housing part 2 is to be equated with an outer side 22 of the base part. Integrated into the base part is a coding element receptacle 3. On the outer side 22, an opening 23 is disposed in the area of the coding element receptacle 3. This opening 23 is assigned a second label field 32. The second label field 32 corresponds to a first label field 31 (see FIG. 3), which is only visible for an installer of the connector 10 when the connector 10 is opened (see FIG. 3).

Figure 3:
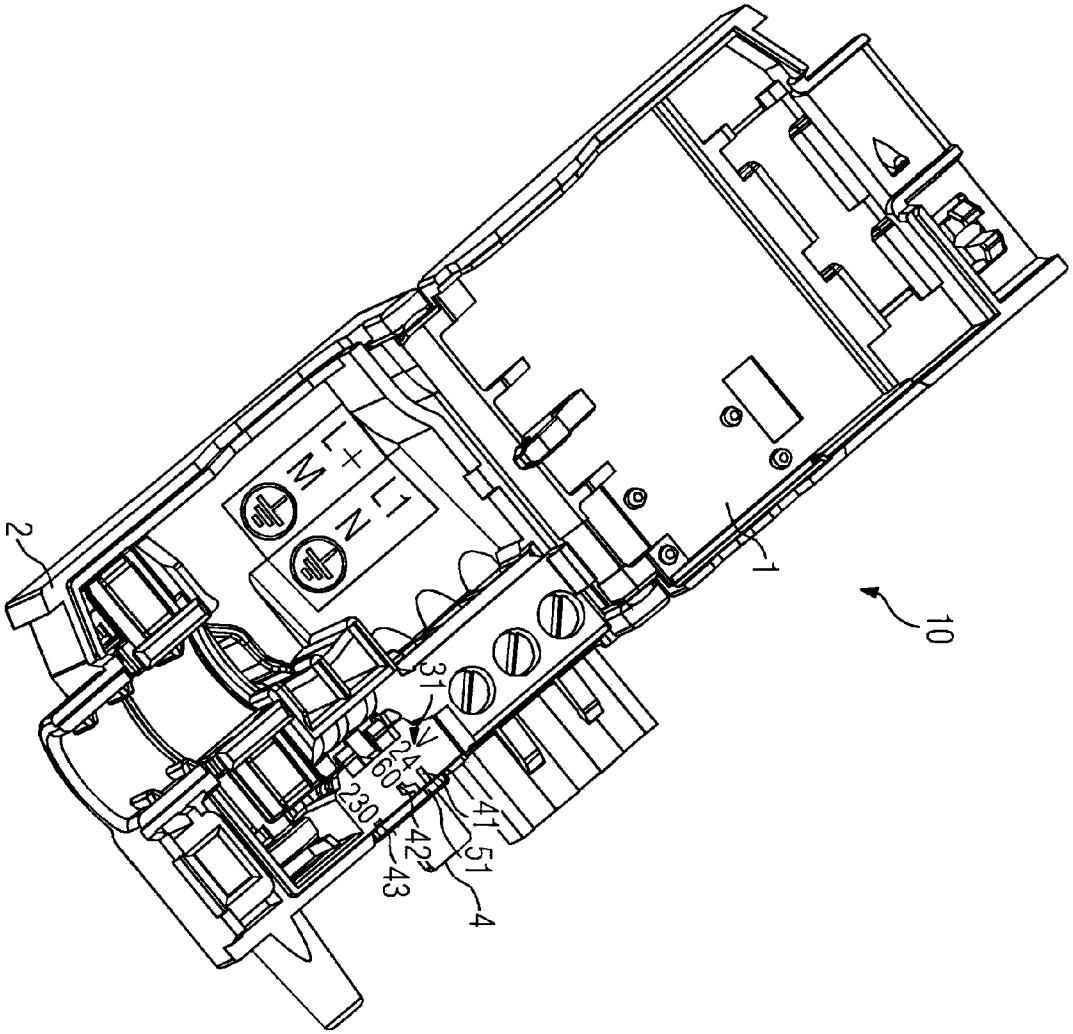
FIG. 3 shows the connector of FIG. 1 with an open flap.

With reference to FIG. 3, the connector 10 is shown as an opened connector 10. The first housing part 1 is formed as a flap and the second housing part 2 is formed as the base part with an inner side 21 and the outer side 22, where, viewed in the direction of the inner side 21, the first label field 31 can be seen.

Figure 4:
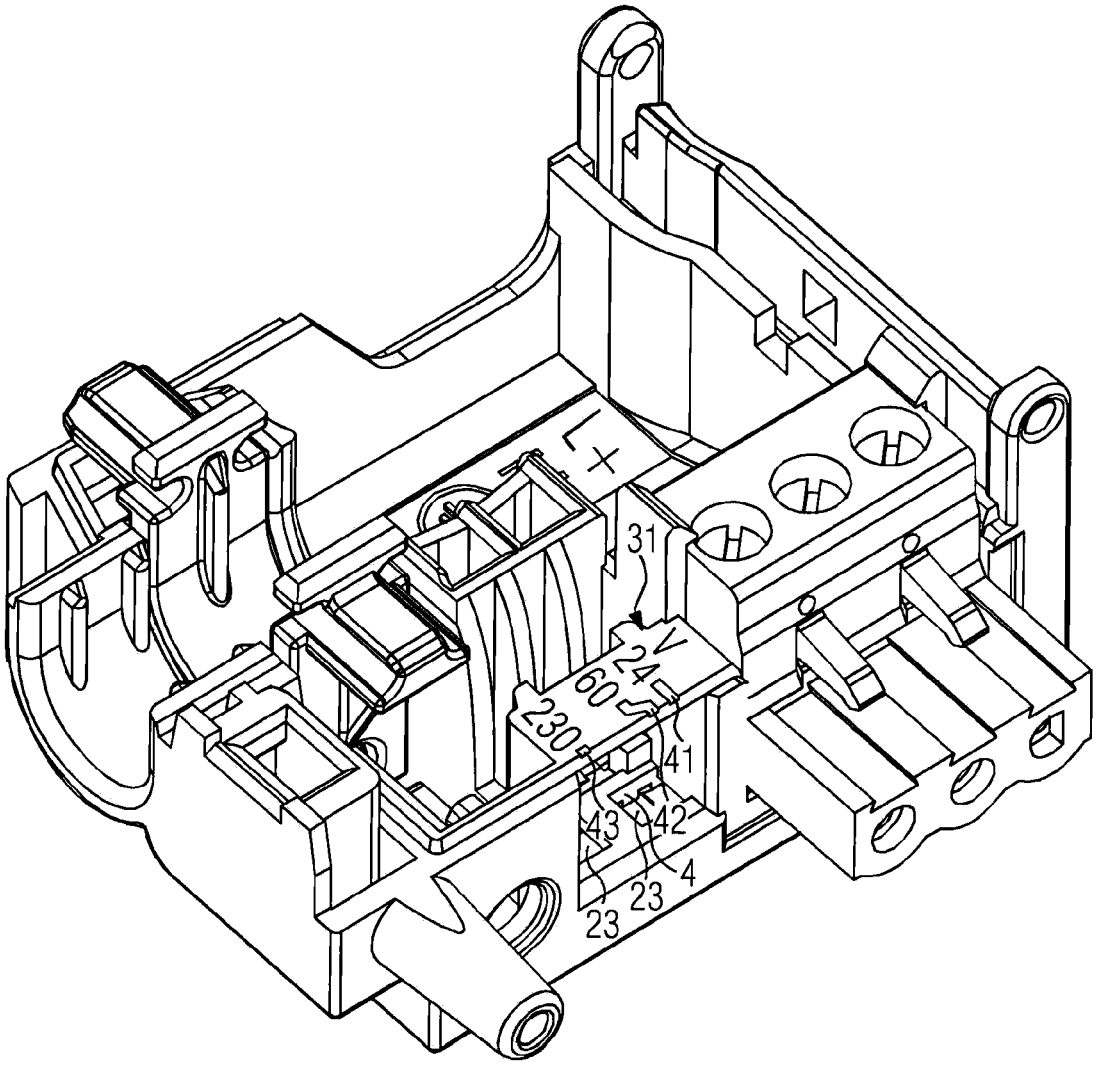
FIG. 4 shows a housing part of the connector of FIG. 1 formed in accordance with the invention as a base part.

FIG. 4 shows the base part with the opening 23 and the first label field 31 in an enlarged view.

Since the first label field 31 on the inner side 21 is no longer immediately visible when the connector 10 is closed, the second label field 32 is disposed on the outer side 22 in the area of the coding element receptacle 3.

The label fields 31, 32, as well as the numbers and letters, have marking lines 41, . . . , 46 for DC voltage and AC voltage information. These marking lines 41, . . . , 46 are disposed such that, depending on the wiring state of the connector, they match markings 51, . . . , 54 disposed on the coding element 4 when the coding element 4 is plugged in.

So that the information content of the wiring configuration information of the first label field 31 is identical to the information content of the wiring configuration information of the second label field 32, the first label field 31 has a first marking line 41, a second marking line 42 and a third marking line 43. The first marking line 41 identifies a selected voltage system of 24 V DC. The second marking line 42 identifies a selected voltage system of 60 V DC. The third marking line 43 identifies a selected voltage system of 230 V AC. For space reasons the numbers and letters are consequently shown abbreviated, especially on the inner side 21.

In order to recognize the respective voltage systems selected even with the flap of the connector 10 closed, corresponding marking lines 44, 45, 46 are disposed on the outer side 22 of the base part in the second label field. A fourth marking line 44, corresponding to the first marking line 41, identifies the voltage system of 24 V DC. A fifth marking line 45, corresponding to the second marking line 42, identifies a voltage system of 60 V DC. A sixth marking line 46, corresponding to the third marking line 43, identifies a voltage system of 230 V AC.

Figure 6:
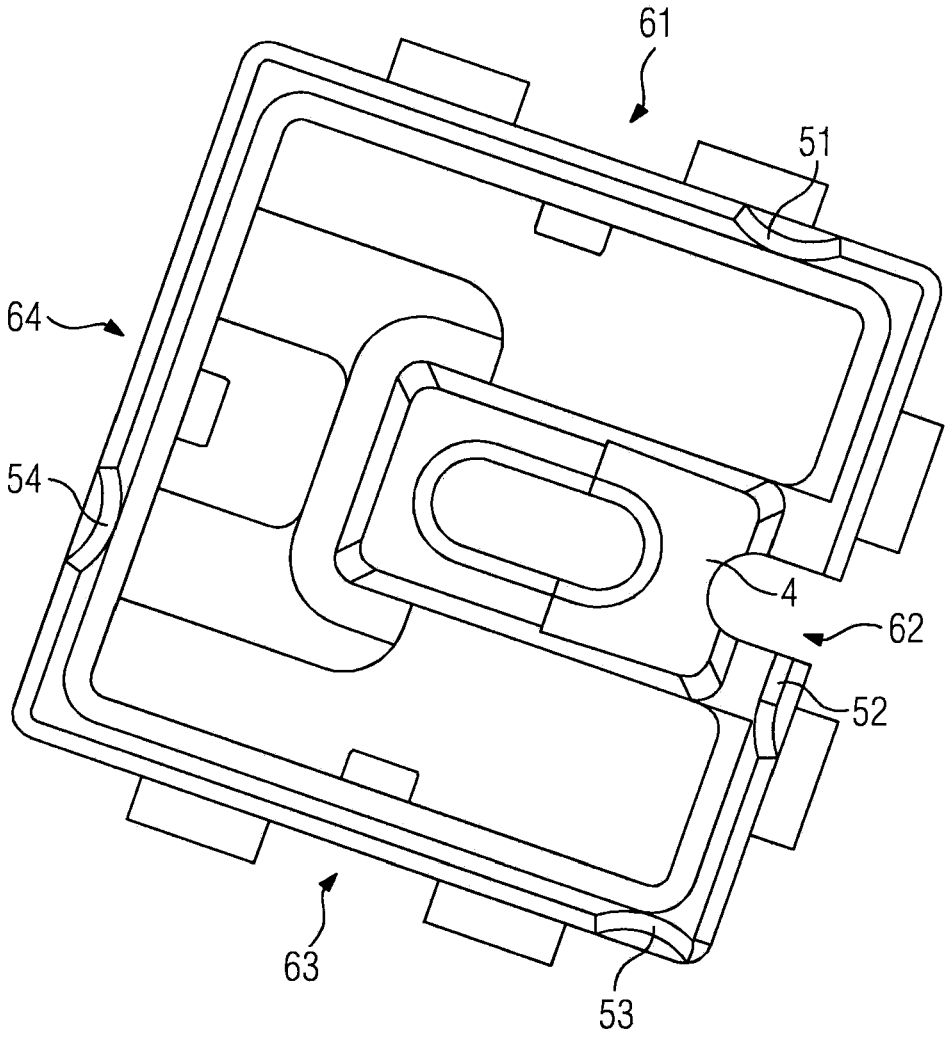
FIG. 6 shows the coding element shown in FIG. 5.

With reference to FIG. 6, the coding element 4 is shown in a three-dimensional view from above, where the coding element 4 is formed in a square shape and the markings are disposed on the side surfaces 61, . . . , 64 such that the markings on opposing side surfaces 61, 63 or 62, 64 correspond to one another and thus the same information is shown in each label field. To this end, a first side surface 61 bears a first marking 51, a second side surface 62 bears a second marking 52, a third side surfaces 63 bears a third marking 53 and a fourth side surface 64 bears a fourth marking 54. The markings 51, . . . , 54 are each formed as longitudinal grooves milled into the surfaces of the square with a red color marking, for example.

Figure 5:
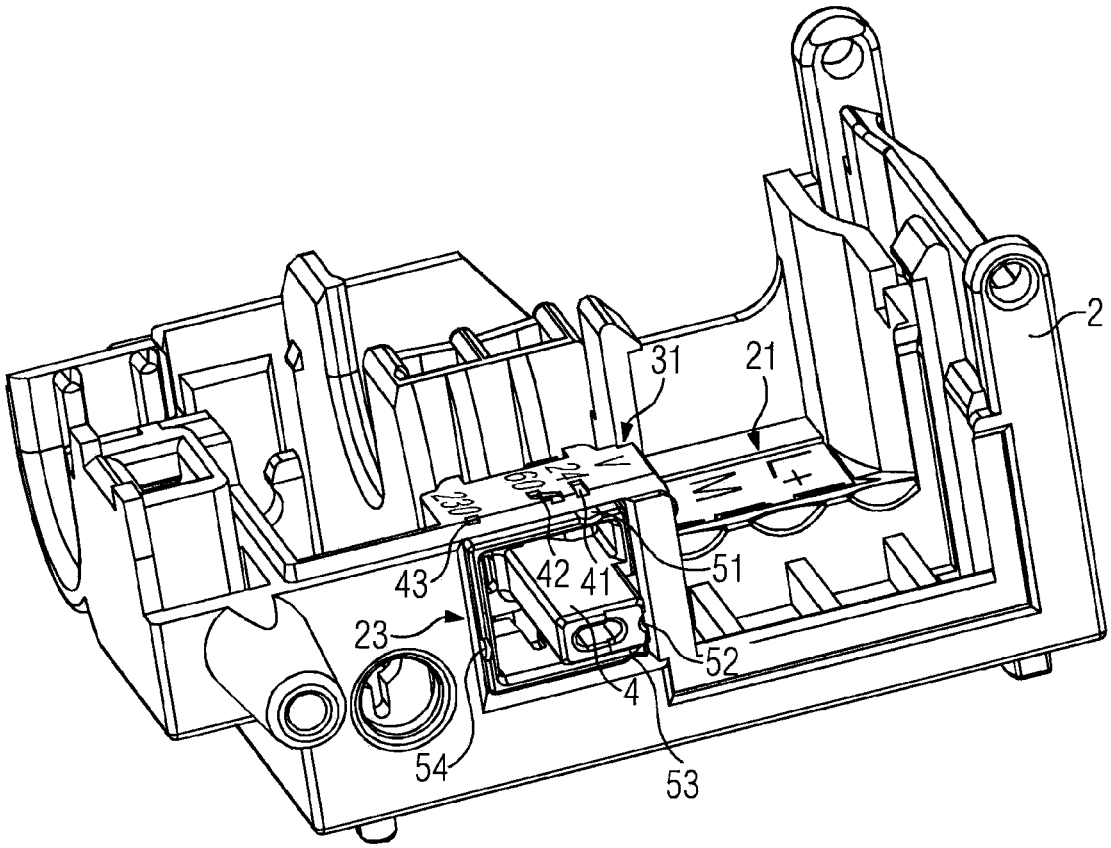
FIG. 5 shows the base part in another view with a plugged in coding element in accordance with the invention.

FIG. 5 depicts the indication of a voltage system with the marking of the coding element 4. The coding element 4 plugs into the opening 23 of the second housing part 2. Looking in the direction of the inner side 21 of the second housing part 2, the first label field 31 is disposed above the opening 23. For a voltage system with 24 V DC, the coding element 4 is now plugged into the opening 23 such that the first marking 51 corresponds with the first marking line 41.

The third marking 53 is disposed on the side surface 63 lying opposite the side surface 61 with the first marking 51 and is accordingly visible in the opening 23 and corresponds with the fourth marking line 44 of the second label field 32 of the outer side 22 of the second housing part 2.

With the connector 10, it is thus advantageous for different supply voltages to be able to be connected for electronic devices or for automation modules 10, for the connected supply voltage to be able to be read from the outside with a closed connector 10 and from the inside with an open connector 10. The display of the connected voltage system or of the voltage system to be connected for an open connector 10 provides additional assistance in the event of the installer being in the process of wiring the connector.

In an advantageous embodiment of a combination of connector 10 and module, the connector 10 is formed such that the coding element 4 is transferred from the module to the connector when the connector is first connected to the module and latches into the connector. For this purpose, the coding element 4 is first pre-installed on the module the first time that the connector 10 is plugged in, the opening 23 slides over the coding elements 4 attached to the module, and because the coding elements 4 has latching lugs (FIG. 6) the coding element 4 latches into the opening 23 of the connector 10 and remains captively plugged into the connector 10.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed:

1. A connector for disconnecting electrical lines from a module or connecting them to said module, comprising a first housing part formed as a flap;

a second housing part formed as a base part having an inner side and an outer side, the first housing part having a hinged connection to the second housing part for folding the two housing parts together into one housing; and a coding element receptacle for accepting a coding element, which interacts with a mating coding element disposed in the module, the coding element being integrated into the base part and, as viewed towards the inner side, bears a first label field, and the coding element and the mating coding element being formed in accordance with a lock-and-key principle;

wherein the base part is formed on the outer side in an area of the coding element receptacle with an opening and a second label field assigned to the opening, in addition to numbers and letters, the first and second label fields having marking lines which are disposed such that, when the coding element is plugged into the mating coding element disposed in the module, the marking lines match markings disposed on the coding element.

2. The connector as claimed in claim 1, wherein the label fields are provided with wiring configuration information relating to the electrical lines.

3. The connector as claimed in claim 2, wherein informational content of the wiring configuration information of the first label field is essentially identical to informational content relating to the wiring configuration information of the second label field.

4. The connector as claimed in claim 1, wherein the coding element is formed so that it latches into the coding element receptacle in a captive manner.

5. The connector as claimed in claim 4, wherein the coding element is formed in a square shape and the markings are disposed on side surfaces such that markings on opposite side surfaces correspond with one another and such that the same information is shown in each label field.

6. The connector as claimed in claim 1, wherein the connector comprises a power supply connection for automation modules having operating voltages for voltage systems selected from the group consisting of: 24 V DC, 24 V/28 V/60 V DC, 120 V and 230 V AC.

7. The connector as claimed in claim 1, wherein the connector is formed such that the coding element, upon first connection to the module, is transferred from the module to the connector and latches into said connector.

* * * * *